US008777005B2

(12) United States Patent
Lai

(10) Patent No.: US 8,777,005 B2
(45) Date of Patent: Jul. 15, 2014

(54) HEX KEY HOLDER

(71) Applicant: Liang-Tzu Lai, Taichung (TW)

(72) Inventor: Liang-Tzu Lai, Taichung (TW)

(73) Assignee: Jaco International Corporation, Taichung (TW)

( * ) Notice: Subject to any disclaimer, the term of this patent is extended or adjusted under 35 U.S.C. 154(b) by 0 days.

(21) Appl. No.: 14/181,712

(22) Filed: Feb. 16, 2014

(65) Prior Publication Data

US 2014/0151253 A1 Jun. 5, 2014

(51) Int. Cl.
*B65D 85/20* (2006.01)
*B25H 3/00* (2006.01)

(52) U.S. Cl.
CPC ..... *B25H 3/003* (2013.01)
USPC ..... 206/377

(58) Field of Classification Search
USPC ..... 206/372, 373, 376, 377, 379; 211/69, 211/70.6
See application file for complete search history.

(56) References Cited

U.S. PATENT DOCUMENTS

| | | | | | |
|---|---|---|---|---|---|
| 3,997,053 | A * | 12/1976 | Bondhus | 206/377 |
| 5,394,984 | A * | 3/1995 | Aiba | 206/377 |
| 5,816,401 | A * | 10/1998 | Vasudeva et al. | 206/377 |
| 5,918,741 | A * | 7/1999 | Vasudeva | 206/376 |
| 5,938,028 | A * | 8/1999 | Hu | 206/377 |
| D415,403 | S * | 10/1999 | Sterpka et al. | D8/71 |
| 6,425,489 | B1 * | 7/2002 | Cunningham | 211/70.6 |
| 2008/0202963 | A1 * | 8/2008 | Liao | 206/377 |
| 2013/0112635 | A1 * | 5/2013 | Tsukaguchi | 211/70.6 |
| 2013/0306508 | A1 * | 11/2013 | Gallegos | 206/377 |

* cited by examiner

*Primary Examiner* — Jacob K Ackun

(57) ABSTRACT

A hex key holder is provided with a rectangular body having a top surface, a bottom surface, a front surface, a rear surface, a right side, and a left side, the rectangular body including a plurality of first channels longitudinally penetrating the rectangular body and being adjacent to the rear surface, an intermediate transverse groove formed on the front surface, a plurality of second channels longitudinally penetrating a lower portion of the rectangular body from the groove to the bottom surface and being adjacent to the front surface, a plurality of first holes formed on the top surface adjacent to the first channels, and a plurality of second holes formed on the bottom surface between the first channels and the second channels; and a ring pivotably disposed on the left side. Each first or second channel retains a hex key.

1 Claim, 12 Drawing Sheets

HEX KEY HOLDER

BACKGROUND OF THE INVENTION

1. Field of the Invention

The invention relates to tool cases and more particularly to a hex key holder.

2. Description of Related Art

A conventional hex key holder comprises a flat body having top and bottom surfaces, an enclosure portion, and a top portion extending above the enclosure portion; a lid pivotably connected to a side of the body and being pivotable onto the body and securable thereto so as to define an enclosed area in the enclosure portion, the lid and the body, when the lid is closed, cooperatively defining holes into the enclosed area, each hole having an axis parallel to the side of the body, each hold configured to receive a hex key; and a block removably secured to the top portion of the body and positioned to block removal of the hex keys from the holes when the lid is secured against the body. The block is not removable from the body as long as the lid is secured against the body.

Notwithstanding the prior art, the invention is neither taught nor rendered obvious thereby.

SUMMARY OF THE INVENTION

It is therefore one object of the invention to provide a hex key holder a rectangular body having a top surface, a bottom surface, a front surface, a rear surface, a right side, and a left side, the rectangular body comprising a plurality of first channels longitudinally penetrating the rectangular body and being adjacent to the rear surface, an intermediate transverse groove formed on the front surface, a plurality of second channels longitudinally penetrating a lower portion of the rectangular body from the groove to the bottom surface and being adjacent to the front surface, a plurality of first holes formed on the top surface adjacent to the first channels, and a plurality of second holes formed on the bottom surface between the first channels and the second channels; and a ring pivotably disposed on the left side; wherein the first channels are of different sizes; wherein the second channels are of different sizes; wherein each of the first channels are configured to retain a first hex key; and wherein each of the second channels are configured to retain a second hex key different from the first hex key.

The above and other objects, features and advantages of the invention will become apparent from the following detailed description taken with the accompanying drawings.

DETAILED DESCRIPTION OF THE INVENTION

Figure 1:
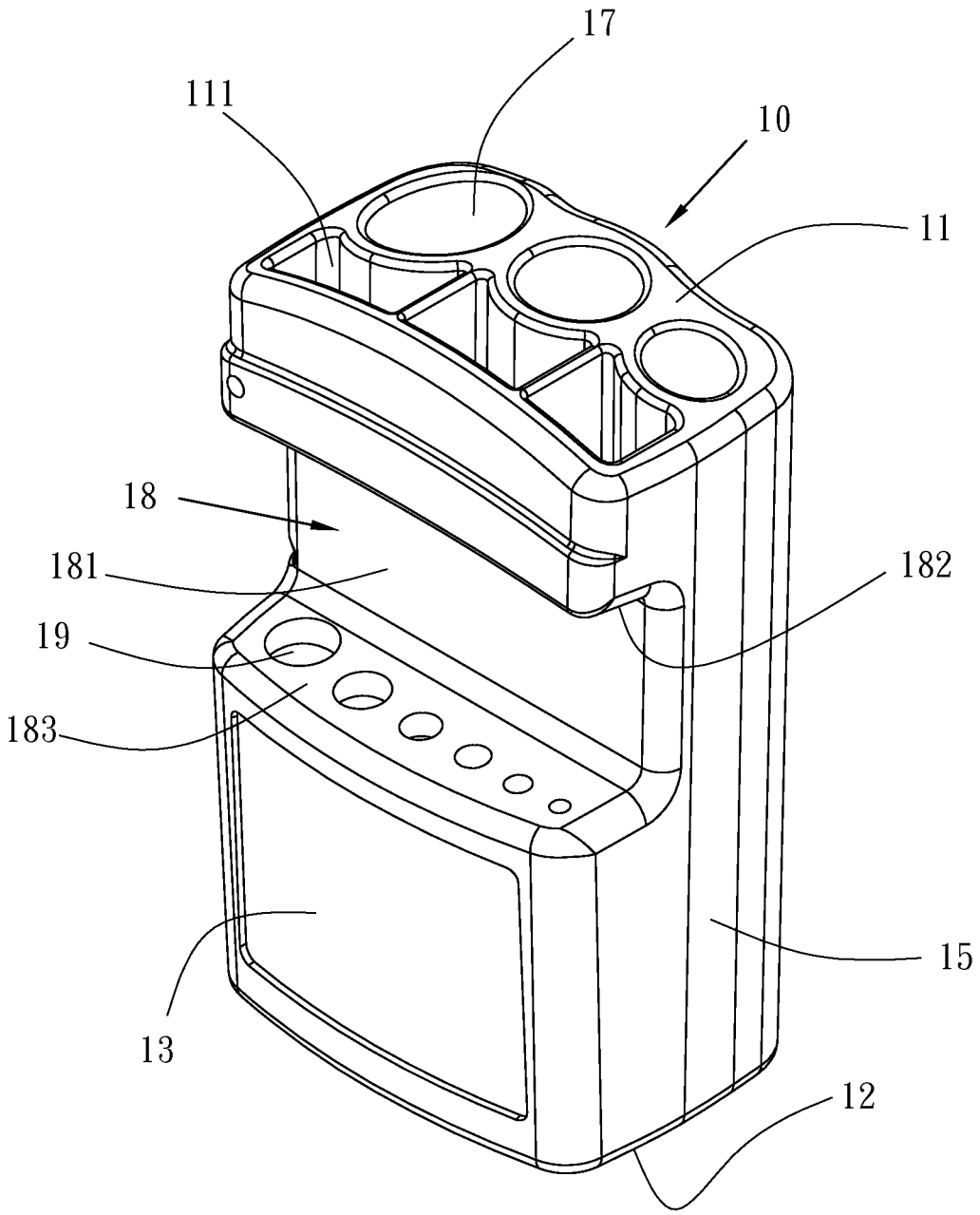
FIG. 1 is a perspective view of a hex key holder according to the invention.
Figure 2:
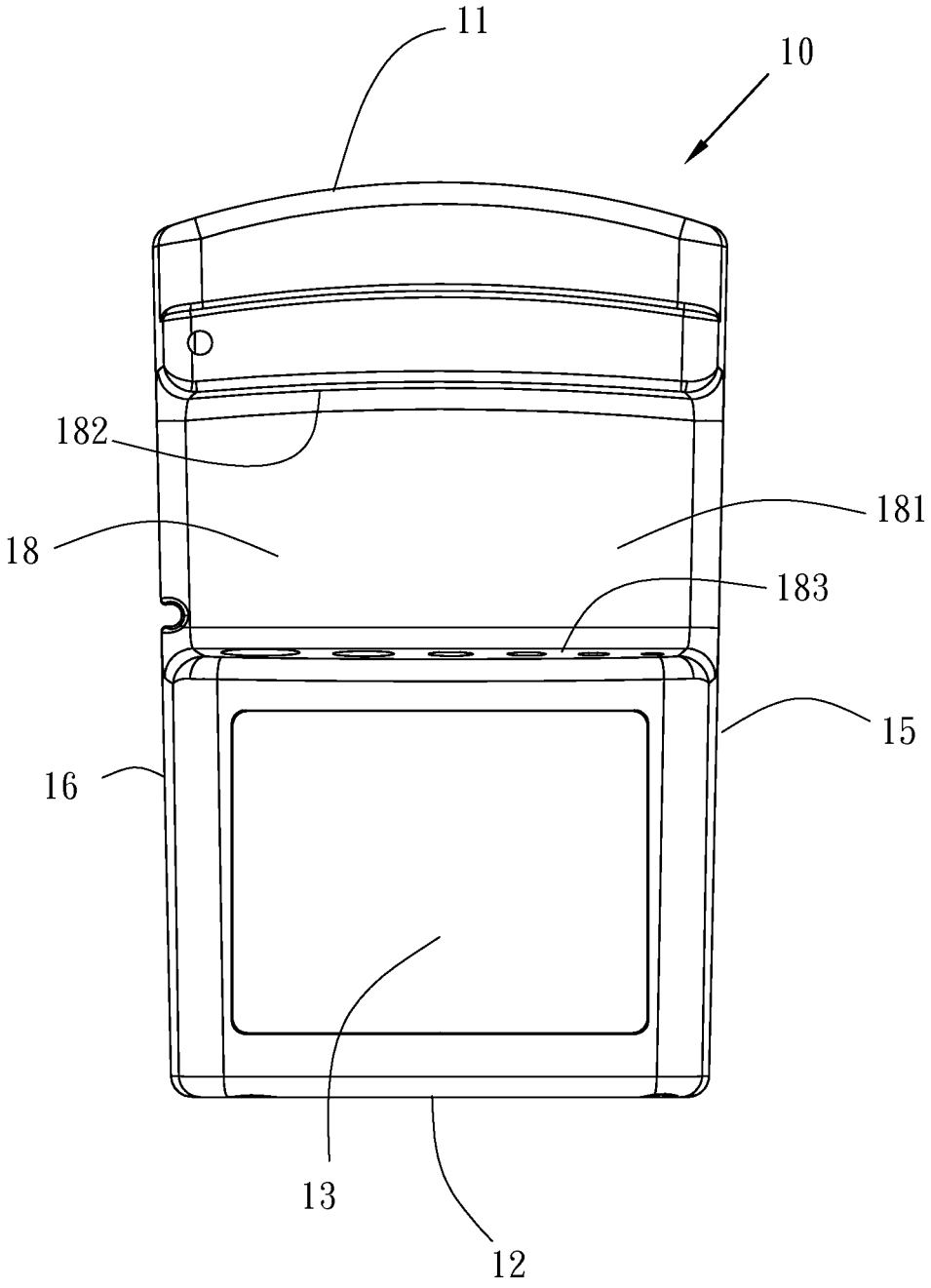
FIG. 2 is a front view of the hex key holder.
Figure 3:
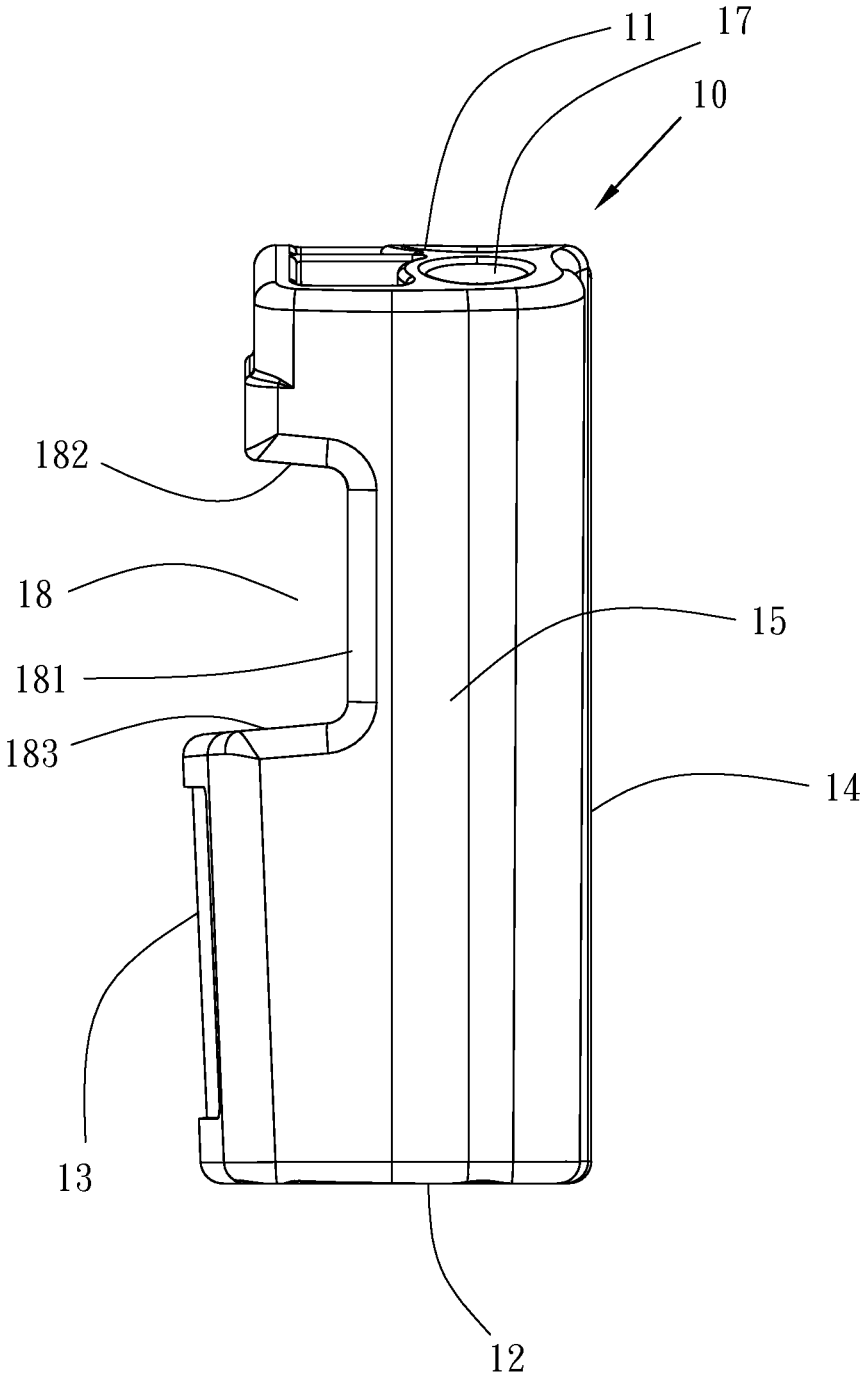
FIG. 3 is a right side view of the hex key holder.
Figure 4:
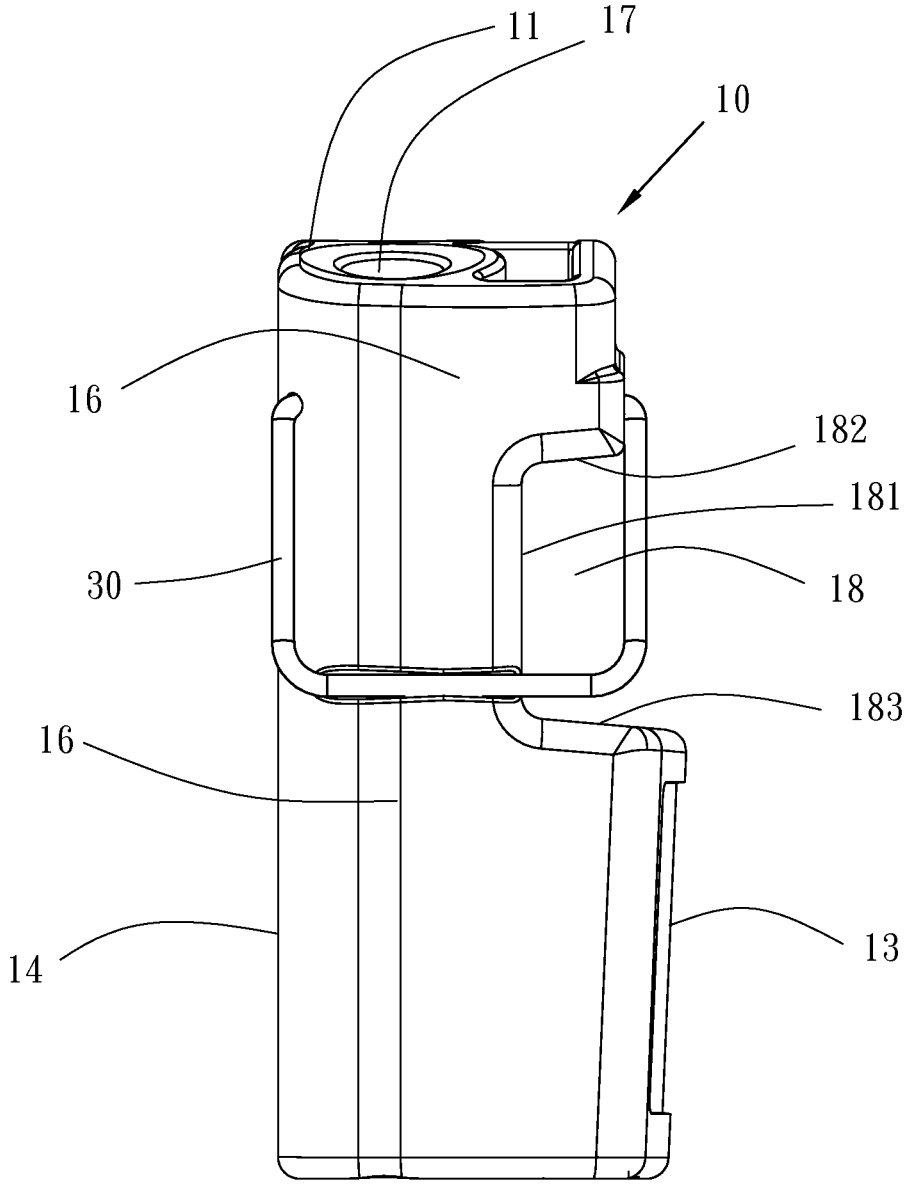
FIG. 4 is a left side view of the hex key holder.
Figure 5:
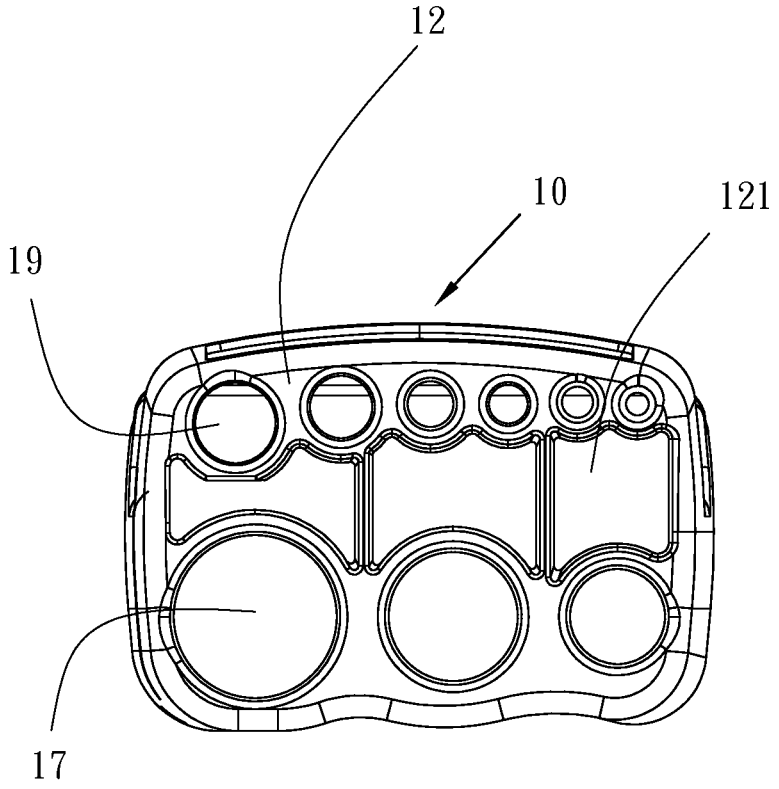
FIG. 5 is a bottom view of the hex key holder.
Figure 6:
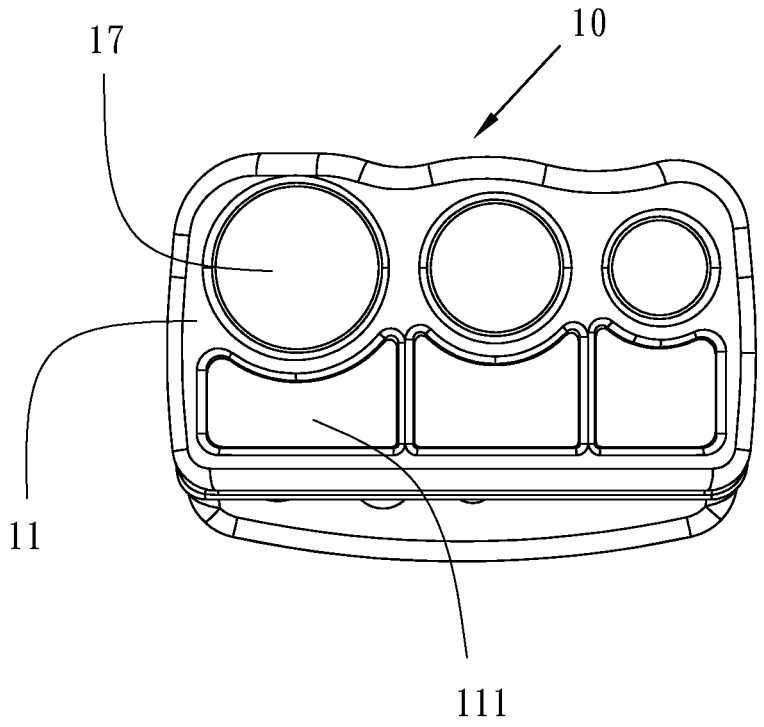
FIG. 6 is a top view of the hex key holder.

Referring to FIGS. 1 to 12, a hex key holder in accordance with the invention comprises the following components as discussed in detail below.

A rectangular body 10 comprises a top surface 11, a bottom surface 12, a front surface 13, a rear surface 14, a right side 15, a left side 16, a plurality of circular first channels 17 longitudinally penetrating the body 10 from top to bottom and being adjacent to the rear surface 14, an intermediate transverse groove 18 on the front surface 13, the groove 18 including a depression 181, a top edge 182, and a bottom edge 183, and a plurality of circular second channels 19 longitudinally penetrating a lower portion of the body 10 from the bottom edge 183 of the groove 18 to the bottom surface 12 and being adjacent to the front surface 13. The first channels 17 are of different sizes (i.e., different diameters). The second channels 19 are of different sizes (i.e., different diameters).

Moreover, a plurality of first holes 111 are formed on the top surface 11 adjacent to the first channels 17, and a plurality of second holes 121 are formed on the bottom surface 12 between the first channels 17 and the second channels 19 both for the purposes of reducing weight and increasing structural strength of the holder. In addition, a pivotal ring 30 is provided on the left side 16 for hanging on a hook.

A plurality of first hex keys 21 of different sizes are retained in the first channels 17. Each first hex key 21 has a short end disposed above the first channel 17 and a long end projecting out of a bottom opening of the first channel 17. A plurality of second hex keys 22 of different sizes are retained in the second channels 19. Each second hex key 22 has a long end projecting out of a bottom opening of the second channel 19 and a short end 221 shaped a ball and urging against the top edge 182 of the groove 18. Each first hex key 21 is greater than each second hex key 22.

Figure 7:
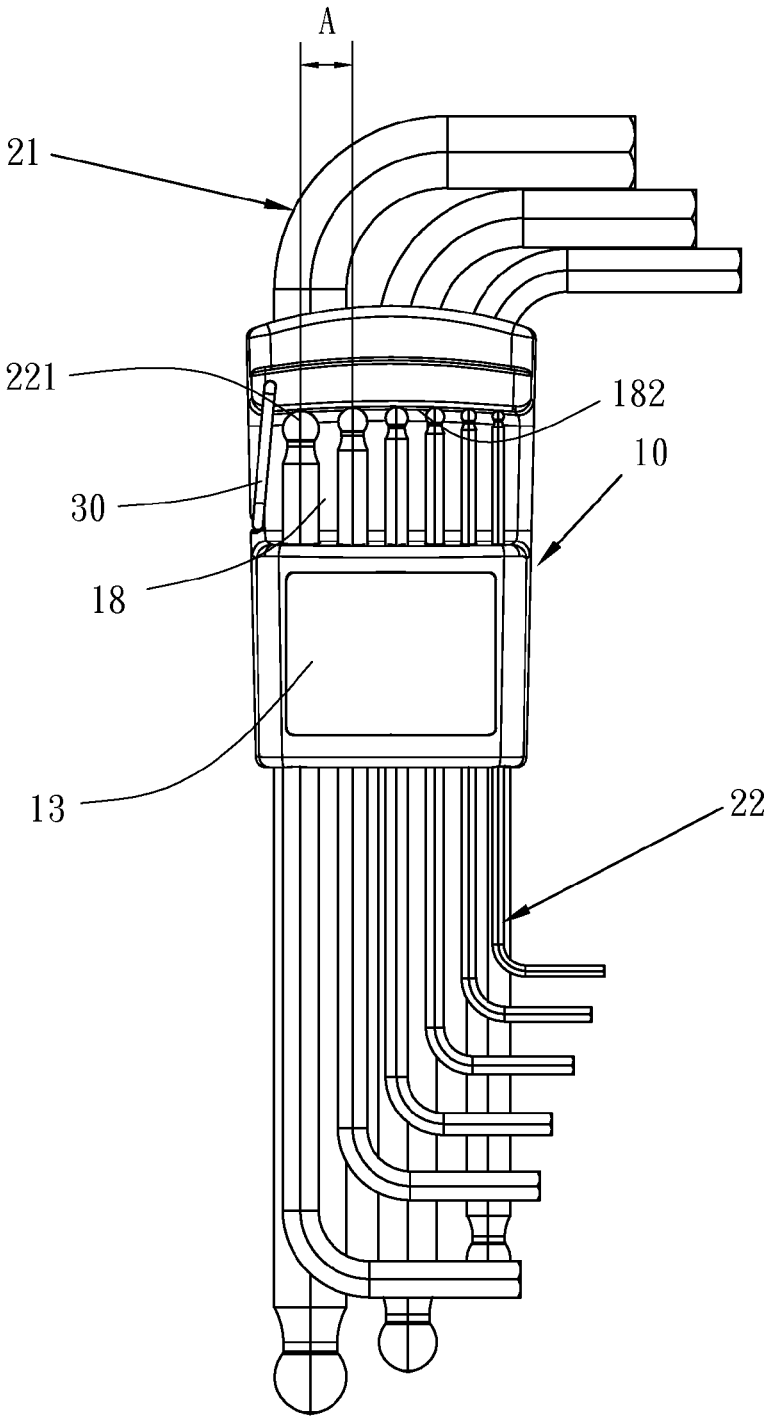
FIG. 7 is a front view of the hex key holder showing hex keys stored in the holder.
Figure 8:
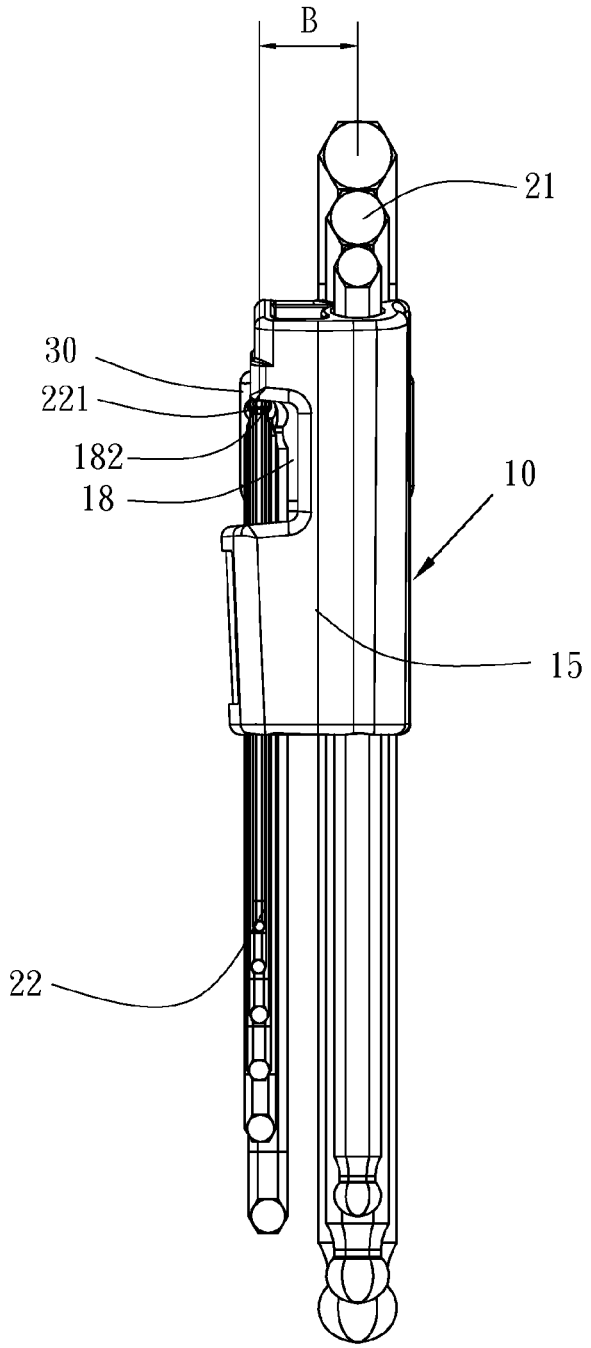
FIG. 8 is a right side view of the hex key holder shown in FIG. 7.
Figure 9:
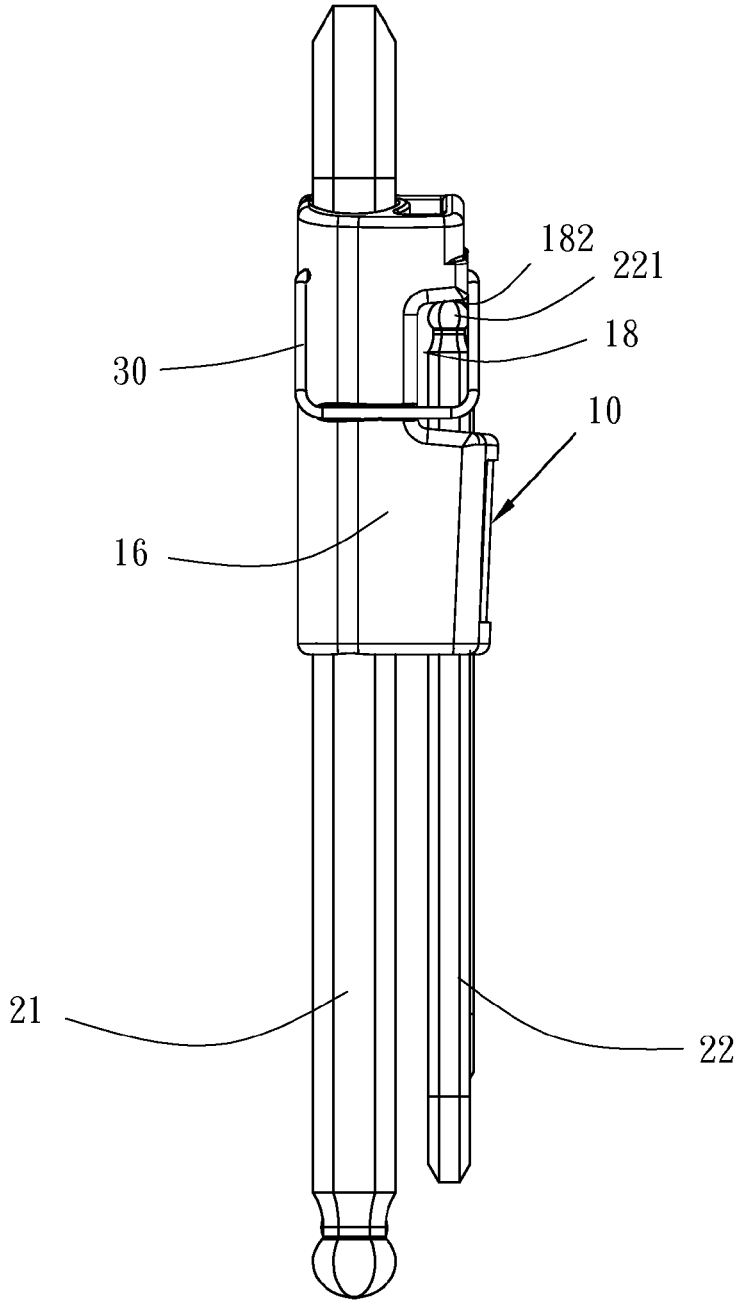
FIG. 9 is a left side view of the hex key holder shown in FIG. 7.
Figure 10:
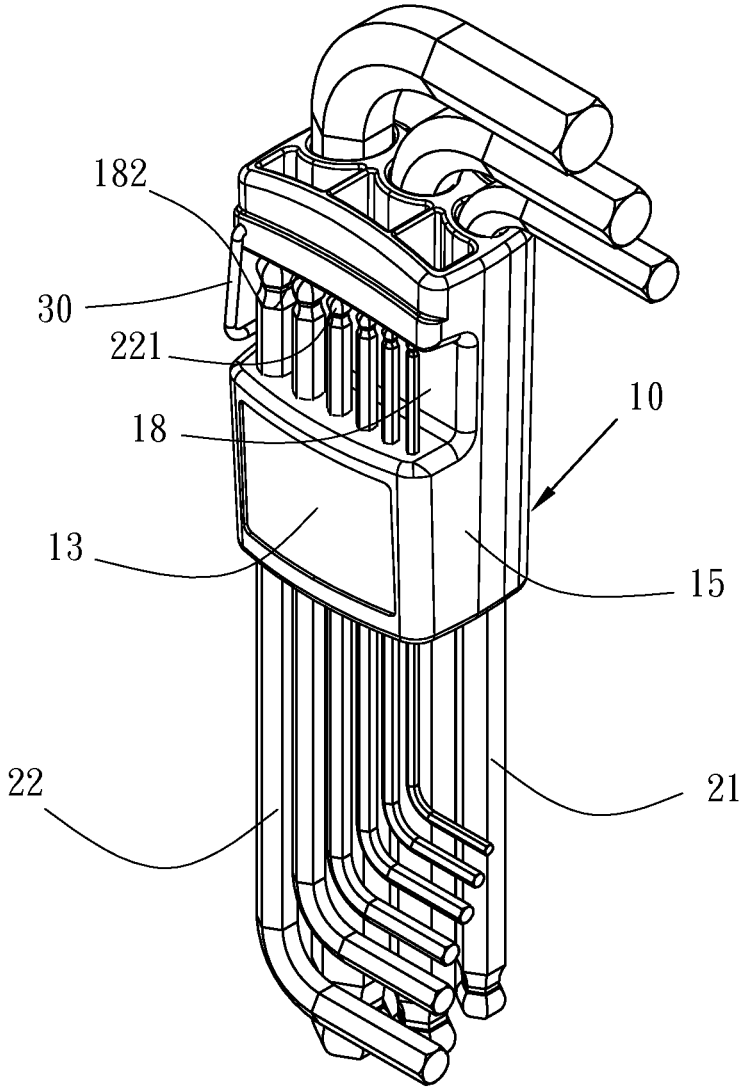
FIG. 10 is a perspective view the hex key holder shown in FIG. 7.
Figure 11:
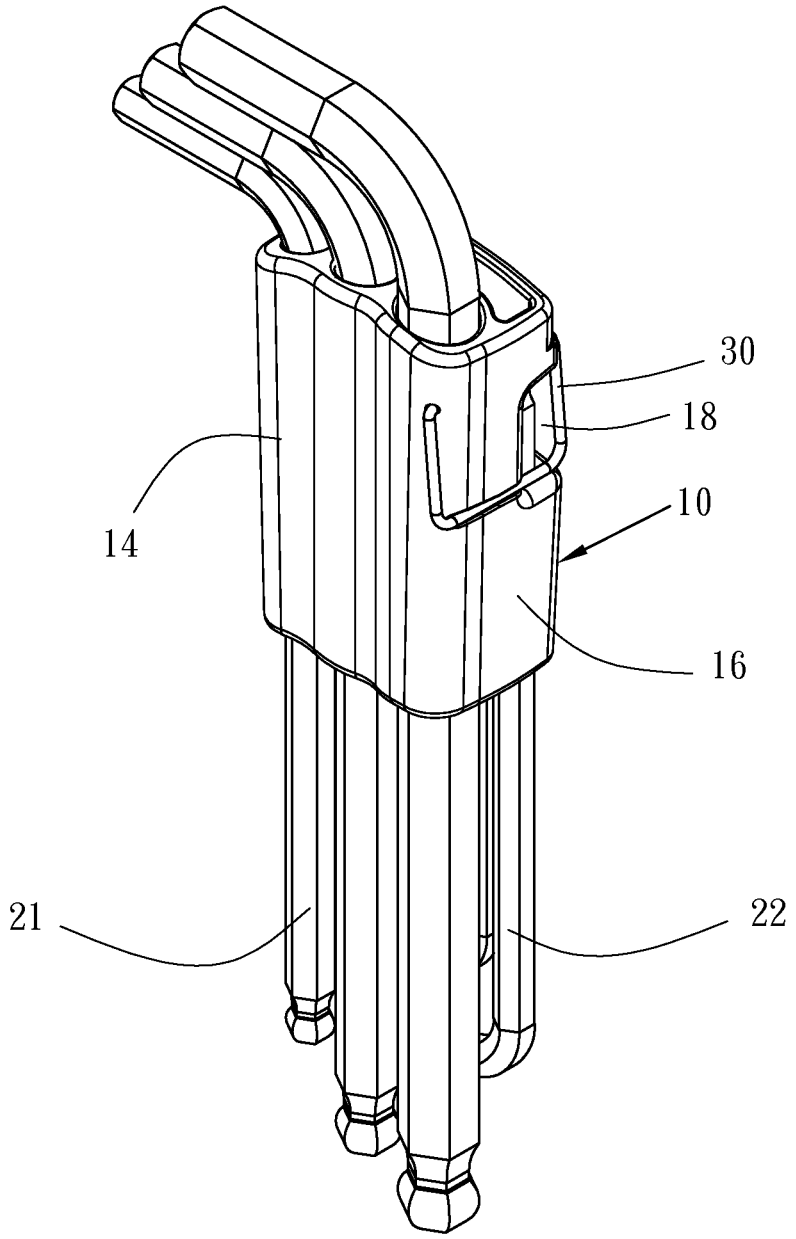
FIG. 11 is another perspective view of the hex key holder shown in FIG. 10.
Figure 12:
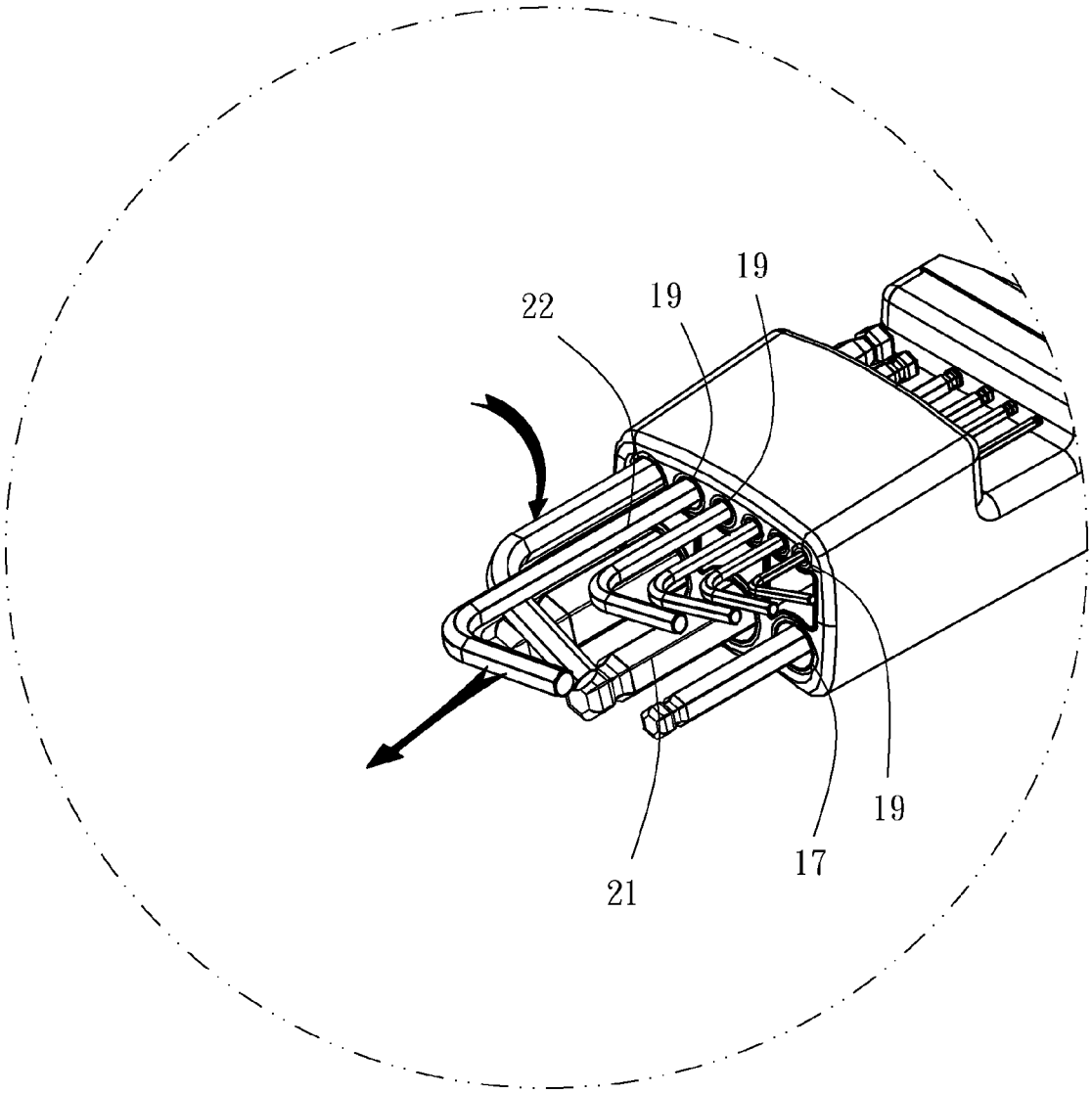
FIG. 12 is an enlarged view of the lower portion of FIG. 10 showing how to remove the hex key out of the holder.

A distance between two adjacent second hex keys 22 is designated by a reference numeral A (see FIG. 7). A distance between the parallel first hex key 21 and second hex keys 22 is designated by a reference numeral B (see FIG. 8). Above arrangements allow an easy removal of the second hex keys 22 (see FIG. 12).

While the invention has been described in terms of preferred embodiments, those skilled in the art will recognize that the invention can be practiced with modifications within the spirit and scope of the appended claims.

What is claimed is:

1. A hex key holder comprising:

a rectangular body having a top surface, a bottom surface, a front surface, a rear surface, a right side, and a left side, the rectangular body comprising a plurality of first channels longitudinally penetrating the rectangular body and being adjacent to the rear surface, an intermediate transverse groove formed on the front surface, a plurality of second channels longitudinally penetrating a lower portion of the rectangular body from the groove to the bottom surface and being adjacent to the front surface, a plurality of first holes formed on the top surface adjacent to the first channels, and a plurality of second holes formed on the bottom surface between the first channels and the second channels; and a ring pivotably disposed on the left side or the right side;

wherein the first channels are of different sizes;

wherein the second channels are of different sizes;

wherein each of the first channels are configured to retain a first hex key; and wherein each of the second channels are configured to retain a second hex key having a size different from the first hex key.

* * * * *